US011619472B1

(12) United States Patent
Major

(10) Patent No.: US 11,619,472 B1
(45) Date of Patent: Apr. 4, 2023

(54) HEAVY BLADE EXPANDABLE BROADHEAD

(71) Applicant: BERRY MTN., INC., Liverpool, PA (US)

(72) Inventor: Jarrod Burk Major, Liverpool, PA (US)

(73) Assignee: Berry Mtn., Inc., Liverpool, PA (US)

( * ) Notice: Subject to any disclaimer, the term of this patent is extended or adjusted under 35 U.S.C. 154(b) by 0 days.

(21) Appl. No.: 17/508,608

(22) Filed: Oct. 22, 2021

Related U.S. Application Data

(60) Provisional application No. 63/106,485, filed on Oct. 28, 2020.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,564,713 A * 10/1996 Mizek ..... F42B 6/08 473/583
6,171,206 B1 * 1/2001 Liechty, II ..... F42B 6/08 473/583
6,287,223 B1 * 9/2001 Liechty, II ..... F42B 6/08 473/583
6,287,224 B1 * 9/2001 Liechty, II ..... F42B 6/08 473/583
6,793,596 B1 * 9/2004 Sullivan ..... F42B 6/08 473/583
6,830,523 B1 * 12/2004 Kuhn ..... F42B 6/08 473/583
8,684,869 B1 * 4/2014 Perry ..... F42B 6/08 473/583
2002/0151393 A1 * 10/2002 Liechty, II ..... F42B 6/08 473/578
2012/0040787 A1 * 2/2012 Ulmer ..... F42B 6/08 473/583
2017/0184381 A1 * 6/2017 Loa ..... F42B 6/08
2020/0173760 A1 * 6/2020 Albanese ..... F42B 6/08

* cited by examiner

*Primary Examiner* — John A Ricci
(74) *Attorney, Agent, or Firm* — Hooker & Habib, P.C.

(57) ABSTRACT

An expandable broadhead includes blades pivotally mounted on a ferrule for movement between retracted and extended positions, and a cam device that resists initial movement of the blades from their retracted positions towards their extended positions. The cam device can prevent the blades from extending prematurely by contact with leaves, light brush, or the like prior to impacting an intended target.

23 Claims, 4 Drawing Sheets

HEAVY BLADE EXPANDABLE BROADHEAD

RELATED APPLICATION

This application claims the benefit of and priority to U.S. Patent Application Ser. No. 63/106,485 "Heavy Blade Expandable Broadhead" filed Oct. 28, 2020 and pending on the filing date of this application, the drawings of the '485 application being incorporated by reference as if fully set forth herein.

FIELD OF THE DISCLOSURE

The disclosure relates generally to archery equipment, namely broadheads, and in particular, to expandable broadheads.

BACKGROUND OF THE DISCLOSURE

Broadheads are a type of arrowhead mounted on the front of arrows and crossbow bolts (arrows and crossbow bolts are referred to collectively as arrows). Expandable broadheads have blades that are initially retracted when launched and then extend outwardly preferably upon impact with a target to expose cutting edges. The retracted blades reduce aerodynamic drag during arrow flight, increasing range and improving accuracy.

Some expandable broadheads extend their blades almost immediately after launch. The increased drag shortens the broadhead's range and impairs accuracy.

Yet other broadheads utilize O-rings and other external attachment structures to maintain the retracted positions of the blades during flight. These attachment structures often need to be replaced or are lost after multiple uses of the broadhead.

The power and launch speed of modern crossbows are increasing. Broadheads shot from modern crossbows hit the target with greater speed and impact force. There is then also a need for expandable broadheads that can stand up to the greater launch speeds and impact forces of modern crossbows.

SUMMARY OF THE DISCLOSURE

Disclosed is a broadhead that has simplified construction, does not require O-rings or other external attachment structures to maintain the retracted position of the blades during flight, enables the archer to easily move extended blades back to their retracted positions without manipulating O-rings or other external structures, can be made with relatively thick blades that can withstand the impact forces generated by modern crossbows, and the force required to move the blades from the retracted position to the extended position can be easily controlled by design so that the blades do not extend prematurely by contact with leaves, light brush, or the like when using the broadhead for hunting.

An embodiment of a broadhead in accordance with the present disclosure includes a ferrule extending along a longitudinal axis, two blades pivotally mounted to the ferrule for angular pivotal displacement between retracted and extended positions, and a cam device that resists pivoting of the blades away from their retracted positions until impact of the blades with a target.

The ferrule is a generally cylindrical body for most of its length having a body portion at a tip end of the ferrule and a threaded shank at an opposite back end of the ferrule. The shank extends away from the body portion and is configured for attachment to an arrow. The body has a sharpened tip portion at the tip of the ferrule and the shank extends from the opposite end of the body. In embodiments the tip portion may be a replaceable portion of the ferrule.

The ferrule body includes an elongate through-slot open at opposite sides of the ferrule body. The blades are received into the slot through the respective opposite sides of the slot and are positioned side-by-side in the slot.

In an embodiment of the disclosed broadhead, the blades are pivotally mounted on a common pivot pin extending through the ferrule slot and fixedly attached to the ferrule body. The pivot pin extends through and is closely received in a hole in each blade. The pivot pin defines the pivot axis and attaches the blade to the ferrule, resisting and preventing axial translation of the blade relative to the ferrule. The blades are cut from flat plate with sides separated by the thickness of the plate. The blades are positioned side-by-side in the slot.

A blade extends from a tip or leading end at one end of the blade to a base or trailing end at the opposite end of the blade. A cutting edge is disposed between the base and tip end portions. The hole in the blade is disposed in the base end portion of the blade.

The blades can pivot with respect to the ferrule between angularly-spaced apart retracted and extended positions. The ferrule body obstructs and thereby resists further pivotal movement of the blades from their retracted positions to their extended positions, and also from their extend positions to their retracted positions. That is, the ferrule body resists further pivotal movement of each blade from its retracted position away from its extended position and resists further pivotal movement of each blade from its extended position away from its retracted position and thereby defines the range of pivotal motion of each blade with respect to the ferrule body.

When the blades are in their retracted positions, each blade is received in the slot with the cutting edge of the blade in the slot. The blade extends towards the tip end of the ferrule in extending longitudinally from the pivot pin to the leading end of the blade. The blade is curved extending away from the leading end of the blade and extends partially out of the slot. The exposed part of the blade outside of the slot faces generally towards the tip end of the ferrule.

The exposed portions of the blades are intended to impact against the target after an initial penetration of the ferrule tip into the target. The impact force generates torque or moment urging the blades to move from their retracted positions to their extending positions.

When the blades are in their extended positions, the blades have pivoted away from the tip end of the ferrule towards the shank of the ferrule. The exposed area of the blades expand away from the ferrule body, exposing the cutting edges of the blades outside of the ferrule slot and forming the leading edges of the blades in the direction of the arrow's flight or its movement through the target.

The cam device resists pivotal movement of the blades from their retracted positions towards their extended positions until the exposed tip portions of the blades experience an impact force at the target. The cam device includes an interference member fixedly attached to the ferrule and for each blade a camming member moveable with the blade. The interference member is in the relative path of movement of the camming members and engages the camming members as the blades initially begin moving from their retracted positions to their extended positions.

The interference member and the camming members cooperatively define an interference fit between them that must be cleared to enable the camming members to move past the interference member. Clearing the interference fit generates a force applied by the interference member to the blades resisting pivotal movement of the blades towards their extended positions. The impact force applied to the blades must generate sufficient torque or moment urging the blades to pivot about the pivot pin sufficient to overcome the resistance generated by the interference member in order for the blades to move past the interference member and to their extended positions.

Once the blade camming members clear the interference fit, the blades are essentially free to continue moving to their respective extended positions without interference from the interference member.

In possible embodiments of the cam device each blade includes an open-ended or blind slot extending into the base portion of the blade from an open end to a closed end of the blade slot. The blade slot defines a cantilever beam forming a portion of the blade, the cantilever beam having a bending stiffness.

The blade camming member is attached to or forms a portion of the cantilever beam. For example, the blade camming member may be formed as a protrusion protruding away from the cantilever beam.

The blade camming member is located on the cantilever beam to be immediately adjacent to or closely spaced from the interference member when the blade is in its retracted position. Initial movement of the blade from the retracted position to the extended position is resisted by the interference between the blade camming member and the interference member. The blade camming member transmits the reaction force from the interference member to the cantilever beam, causing the cantilever beam to bend and move the blade camming member away from the interference member and thereby clear the interference fit.

In an embodiment of the camming mechanism with blade slots, the interference member is a pin fixedly attached to the ferrule body. The interference pin is received in the blade slot when the blade is in its retracted position. The interference pin moves relative to the blade slot out of the blade slot as the blade moves from its retracted position to its extended position.

The camming member protrusion on the cantilever beam extends into the blade slot and is closely spaced from the interference pin between the interference pin and the open end of the blade slot when the blade is in its retracted position.

Initial pivotal movement of the blade from its retracted position towards its extended position urged by impact of the broadhead urges relative movement of the interference pin towards the open end of the blade slot. The camming member protrusion contacts and presses against the interference pin. The interference pin applies a reaction force to the camming member protrusion urging the cantilever beam to elastically deflect away from the interference pin.

The blade slot in this embodiment of the cam device includes a blade slot end portion that extends beyond the interference pin in the blade slot when the blade is in the retracted position. The interference pin is never located in this blade slot end portion. But the depth of the blade slot extending into the base portion of the blade from the open end of the blade slot to the closed end of the blade slot determines the effective length of the cantilever beam, and the distance of the blade slot from the base end of the blade determines the effective thickness of the cantilever beam.

The effective length and effective thickness of the cantilever beam in turn defines the effective stiffness of the cantilever beam in bending. The effective stiffness of the cantilever beam and the interference fit between the camming member and the interference pin further in turn establishes the force required to overcome the interference fit. This enables the designer of the disclosed broadhead to design a broadhead in which the blades move out of the ferrule and expand only with application of sufficient impact force expected to result from impact with a target and not by lesser impacts with stray impediments such as leaves or light branches.

After the blades of the broadhead have moved to their extended positions, the archer can press against the exposed back side of each blade opposite the cutting edge to pivot the blade back to its retracted position. The interference pin moves relative to the blade slot back towards the open end of the blade slot and, in doing so, causes the cantilever beam to deflect and generate resistance to movement signaling to the archer that the blade is secured back into its retracted position.

In an alternative embodiment of the camming system that includes the open slot in each blade, the interference pin is located closely spaced from the base end of each blade wherein the blade cantilever beam is disposed between the interference pin and the blade slot. The camming member of the blade is disposed on the side of the cantilever beam adjacent the interference pin and extends away from the cantilever beam to define the interference fit with the interference pin. The camming member may be formed as a protrusion on the side of the cantilever beam away from the blade slot that extends away from the blade slot and does not extend into the blade slot.

The disclosed broadhead has a number of advantages. The cam device reliably resists opening of the blades without the use of O-rings or other external structures that can be lost or broken, and enables reliable closing of the blades by the archer by merely pressing against the blades without need for manipulating O-rings or other external structures.

The blades merely pivot when transitioning between retracted and extended positions without the need to translate along the ferrule as in many broadhead designs, thus simplifying manufacture, assembly, and operation of the broadhead.

Because the blades are side-by-side and merely pivot to open and close the blades, the blades can be made thicker and stronger for use with modern crossbows. For example, blades having a thickness of up to 0.25 inches or more can be accommodated in embodiments of the disclosed broadhead.

Other objects and features of the disclosure will become apparent as the description proceeds, especially when taken in conjunction with the accompanying drawing sheets illustrating one or more illustrative embodiments.

DETAILED DESCRIPTION

Figure 1:
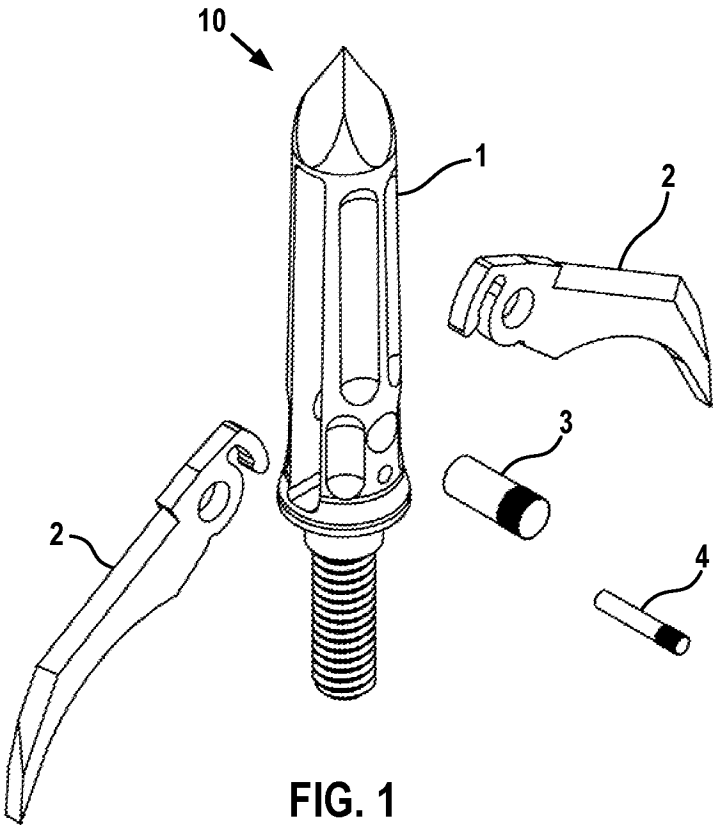
FIG. 1 is an exploded view of an expandable broadhead in accordance with this disclosure.
Figure 5:
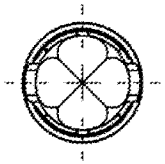
FIGS. 4-9 are views of the ferrule of the broadhead shown in FIG. 1.
Figure 4:
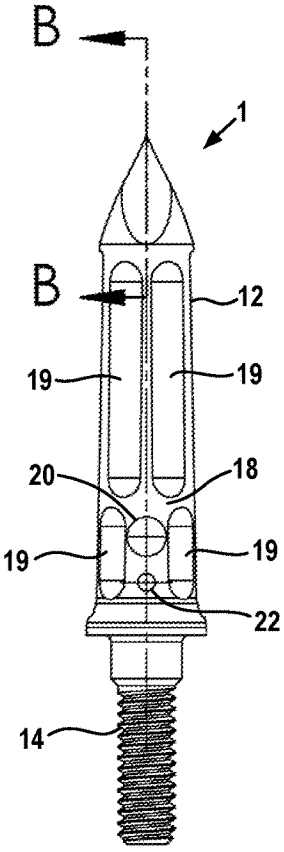
Figure 6:
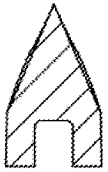
Figure 8:
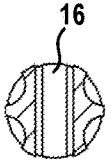
Figure 7:
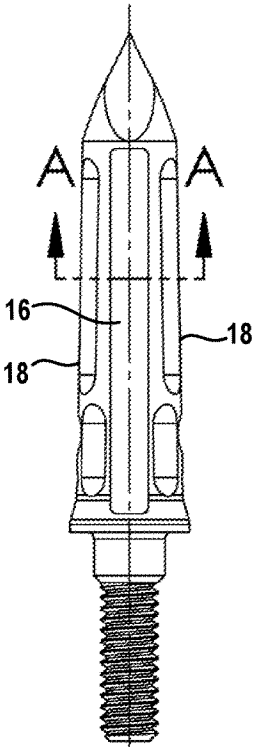
Figure 9:
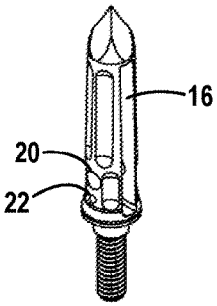
Figure 14:
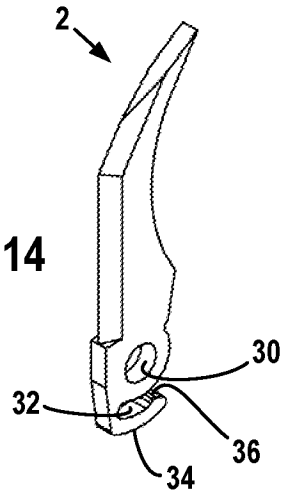
FIG. 14 is a perspective view of the blade shown in FIG. 10.
Figure 13:
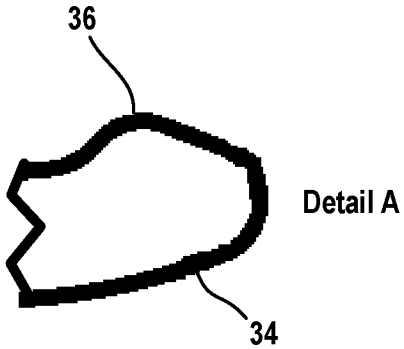
FIG. 13 is an enlarged view of detail A shown in FIG. 10.
Figure 10:
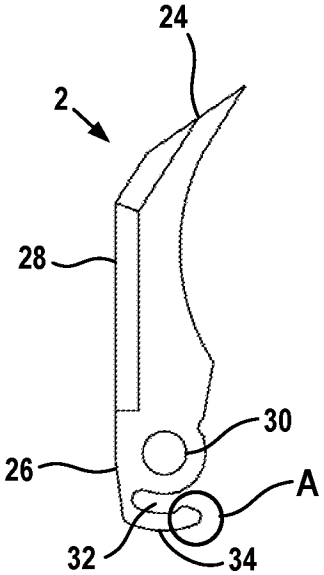
FIG. 10 is a front view of one of the blades of the broadhead shown in FIG. 1.
Figure 12:
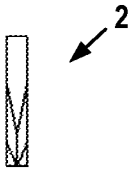
FIGS. 11 and 12 are end and top views of the blade shown in FIG. 10.
Figure 11:
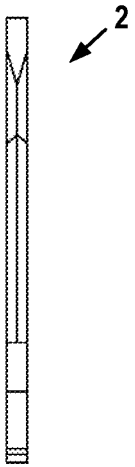

FIG. 1 is an exploded view of a broadhead 10 in accordance with this disclosure. The broadhead 10 weighs 100 grains.

Figure 3:
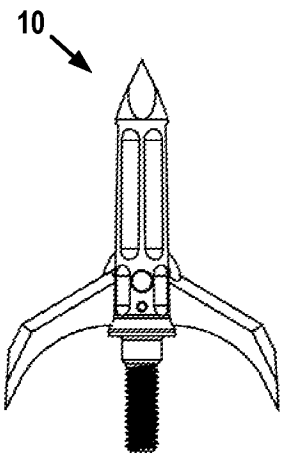
FIG. 3 is similar to FIG. 2 but with the blades in their open or extended positions.
Figure 2:
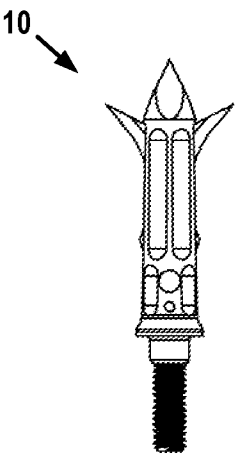
FIG. 2 illustrates the broadhead shown in FIG. 1 with the blades in their closed or retracted positions.

The broadhead 10 includes a ferrule 1, a pair of blades 2, a pivot pin 3, and an interference pin 4. FIG. 2 illustrates the broadhead 10 with the blades 2 in the closed or retracted positions, and FIG. 3 illustrated the broadhead 10 with the blades 2 in their open or extended positions.

FIGS. 4-9 illustrate the ferrule 1. The ferrule is a generally cylindrical member extending along an axis and in the illustrated embodiment is made entirely of titanium for light weight and strength.

The ferrule 1 includes a body 12 on the tip end of the ferrule and a shank 14 extending away from the body. The tip end of the body is sharpened for penetration into a target.

The ferrule body 12 includes an axial through slot 16 that extends a substantial length of the body and opens on opposite sides of the body. The slot defines two opposite outer walls 18 of the body. Axial grooves 19 are formed in the walls 18 to reduce weight and improve balance of the broadhead. A pair of aligned through holes 20 centered on the walls 18 between the open ends of the slot 16 extend through the walls 18 to receive the pivot pin 3. A second pair of aligned through holes 22 spaced towards the shank from the holes 20 also extend through the walls 18 to receive the interference pin 4, the pivot pin 3 and the interference fit.

FIGS. 10-14 illustrate one of the like blades 2. The illustrated blade is cut from 0.054 inch thick flat plate.

The blade 2 includes a tip end portion 24 disposed at the tip end of the blade and a base end portion 26 disposed at the opposite base end of the blade. A cutting edge 28 extends between the tip end and base end portions. A through-hole 30 in the blade base end portion extends perpendicular to the sides of the blade through the thickness of the blade. The hole is sized to closely receive the pivot pin 3. An open-ended or blind slot 32 is formed in the base end portion of the base between the hole 30 and the base end of the blade. The entrance into the slot is sized to closely receive the interference pin 4.

The slot 32 defines a cantilever beam 34 disposed at the base end of the blade. A camming member 36 is formed on the side of the beam 34 facing the slot and extends into the slot. The camming member is disposed at the open end of the slot.

In the illustrated embodiment the slot is about 0.060 inches wide, the cantilever beam is about 0.040 inches thick, and the camming member extends into the slot by about 0.017 inches.

To assemble the broadhead, the blades 2 are inserted into opposite end of the ferrule slot 16 side-by-side as shown in FIG. 1, and the pivot pin 3 and interference pin 4 are attached to the ferrule 1 through the pairs of ferrule holes 20, 22. The pivot pin 3 extends through the blade holes 30 to pivotally mount the blades to the ferrule 1. Contact of the blades 2 with the opposite axial ends of the ferrule slot 16 define the pivotal range of motion of the blades between retracted and extended positions.

FIG. 2 illustrates the broadhead 10 with the blades 2 in their closed or retracted position. The tip end portions 24 of the blades 2 are shaped to extend out of the ferrule slot 16 near the ferrule tip so that impact of the blade tip end portions with the target urge pivotal motion of the blades towards their extended positions shown in FIG. 3.

Figure 15:
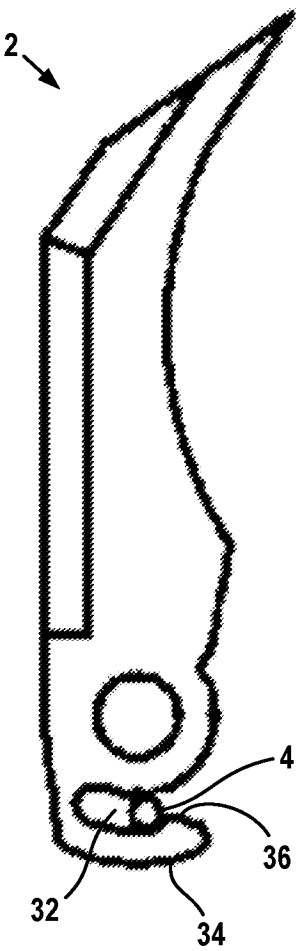
FIG. 15 is a view of the cam device of the broadhead shown in FIG. 1 retaining the blade shown in FIG. 10 in its retracted position.

FIG. 15 illustrates one of the blades 2 in its retracted position, it being understood that the other of the blades 2 would be in a mirror image relationship with the illustrated blade 2 and pivots in the opposite direction of the illustrated blade 2 when moving from its retracted position to its extended position.

The illustrated blade 2 pivots in the clockwise direction as viewed in the figure when moving from the retracted position to the extended position. In its retracted position the interference pin 4 is positioned to extend through the blade slot 36 closely adjacent to the camming member 36. The camming member 36 is in the path of relative movement of the interference pin with respect to the blade 2 moving from its retracted position to its extended position. The camming member 36 resists pivotal movement of the blade 2 away from its retracted position towards its extended position and maintains the blade in its retracted position during arrow flight.

Impact and penetration of the tip of the broadhead 10 against a target applies impact forces to the blade tip end portions 24 urging pivotal movement of the blades away from the retracted positions and towards their extended positions. If the target is within the effective range of the arrow the impact force is sufficient for the force applied by the interference pin 4 against the camming members 36 to deflect the blade cantilever beams 34 sufficiently to clear the interference fit between the interference pin and the camming members, enabling pivotal movement of the blades to their extended positions.

The archer can pivot the extended blades 2 back to their retracted positions for reuse of the broadhead 10. The camming members 36 deflect out of relative pivotal movement of the interference pin 4 and the force applied by the archer to deflect the camming members and the relief of that force when the blades are at their retracted positions provide tactile feedback that the blades are again "locked" in their retracted positions.

In the broadhead 10, the blade slots 34, the camming members 36, and the interference pin 4 define a first embodiment cam device resisting opening of the blades until impact with the target.

Figure 16:
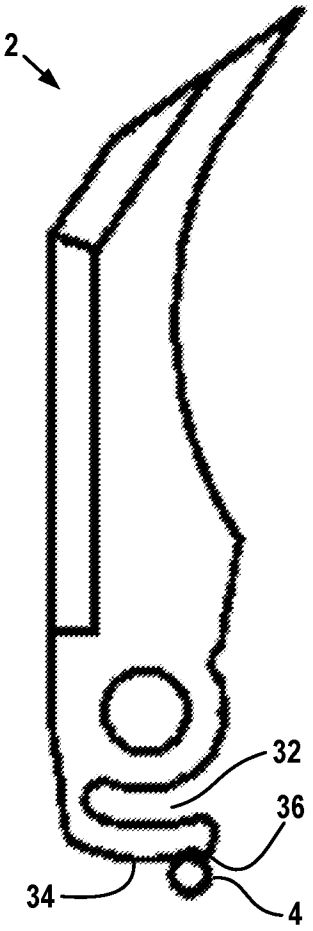
FIG. 16 is similar to FIG. 15 but illustrates a second embodiment cam device retaining the blade shown in FIG. 10 in its retracted position.

FIG. 16 is similar to FIG. 15 in illustrating a blade 2 in its retracted position but illustrates a different arrangement of the blade slots 34, camming members 36 and the interference pin 4 to form a second embodiment cam device resisting pivotal movement of the blade away from its retracted positon.

The slot 36 and the cantilever beam 34 are identical to the slot 36 and the cantilever beam 34 shown in FIG. 21 but the camming member 36 is disposed on the side of the cantilever beam away from the slot 36. The camming member extends away from the cantilever beam and the blade slot 36 into the ferrule slot 16. The interference pin 4 is now located away from and outside of the slot 36 and adjacent to the base end of the blade. The interference pin 4 and the camming member 36 define an interference fit between, them but in this embodiment the cantilever beam deflects towards the slot 36 and towards the pivot axis defined by the pivot pin 3 to clear the interference fit.

Embodiments of the broadhead in accordance with this disclosure similar to the broadhead 10 but sized as a 125 grain broadhead and as a 150 grain broadhead have been developed. These heaver broadheads are especially suited for use on crossbow bolts. The 125 grain and 150 grain broadheads each have blades 0.069 inches thick that are able to withstand the impact forces generated by modern crossbows.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, weight, environment of use, and the like.

What is claimed is:

1. A broadhead comprising:

a ferrule, a blade pivotally mounted to the ferrule for pivotal motion between retracted and extended positions relative to the ferrule, and a cam device that resists pivotal movement of the blade from the retracted position towards the extended position;

the ferrule extending along an axis between a tip end and an opposite back end and comprising a through-slot extending along the axis and open on one side of the ferrule, the blade being disposed substantially within the ferrule slot when the blade is in the retracted position and extending out of the open side of the ferrule when the blade is in the extended position;

the cam device comprising a camming member and an interference member, the camming member being fixed to the blade and movable with the blade along a path of movement of the camming member relative to the ferrule when the blade moves between extended and retracted positions;

the interference member being disposed in the ferrule through-slot and being axially fixed to the ferrule, the interference member being disposed in the path of movement of the camming member;

the camming member and the interference member being disposed to contact one another and cooperatively generate an interference fit between them as the camming member moves along the path of movement, the interference fit resisting movement of the camming member past the interference member and thereby resisting pivotal movement of the blade; and the camming member and the interference member being elastically deformable to clear the interference fit and enable the camming member to move past the interference member if there is sufficient force applied to the blade to clear the interference fit; and the cam device comprising the blade defining a slot extending into the blade from an open end of the slot, the slot having opposite sides and a portion of the blade being formed as a cantilever beam disposed on one side of the slot, the camming member protruding from the cantilever beam whereby the camming member transfers a force to the cantilever beam elastically deflecting the cantilever beam when clearing the interference fit.

2. The broadhead of claim 1 wherein the blade is a first blade and further comprising a second blade like the first blade, the first and second blades being disposed side-by-side in the ferrule through-slot and pivotally mounted for pivotal movement about a common pivot axis between extended and retracted positions, the interference member being in the path of movement of the camming members of both the first and second blades.

3. The broadhead of claim 1 wherein at least a portion of the interference member is disposed in the blade slot when the blade is in its retracted position.

4. The broadhead of claim 3 wherein the camming member protrudes into the slot.

5. The broadhead of claim 4 wherein the blade slot extends from the open end of the slot to a closed end of the slot, the interference member being spaced away from the closed end of the slot when the blade is in its retracted position.

6. The broadhead of claim 5 wherein the camming member is closely adjacent to the interference member when the blade is in its retracted position whereby the interference between the interference member and the camming member occurs substantially upon initial urging of the blade from the retracted position towards the extended position.

7. The broadhead of claim 1 wherein the camming member is disposed on a side of the cantilever beam spaced away from the blade slot, the camming member extending from the said side of the cantilever beam and extending away from the slot.

8. The broadhead of claim 7 wherein the interference member is disposed outside of the blade slot throughout the path of movement of the camming member.

9. The broadhead of claim 8 wherein the camming member is adjacent to the interference member when the blade is in its retracted position whereby the interference between the interference member and the camming member occurs substantially upon initial urging of the blade from the retracted position towards the extended position.

10. The broadhead of claim 1 wherein the blade extends from a forward end to an opposite trailing end, the forward end being adjacent to the tip end of the ferrule when the blade is in the retracted position, and the cantilever beam is disposed on the back end of the blade.

11. The broadhead of claim 1 wherein the blade has a thickness dimension of at least 0.054 inches.

12. The broadhead of claim 11 wherein the blade has a thickness dimension of at least 0.060 inches.

13. The broadhead of claim 1 wherein the interference member is formed as a pin extending through the through-slot of the ferrule parallel with the pivot axis and spaced away from the pivot axis towards the back end of the ferrule.

14. An expandable broadhead comprising:

a ferrule, a pair of blades, a pivot pin, an interference pin, and a cam device;

the ferrule extending along an axis between a tip end and an opposite back end and comprising a through-slot extending along the axis and open on opposite sides of the ferrule;

the pivot pin fixedly attached to the ferrule and extending through the through-slot of the ferrule, the pivot pin defining a pivot axis perpendicular to the ferrule axis;

the blade being pivotally mounted side-by-side on the pivot pin, each blade capable of pivotal motion about the pivot axis between retracted and extended positions relative to the ferrule, the blades being disposed substantially within the ferrule through-slot when the blades are in their retracted positions and extending out of opposite sides of the ferrule through-slot when the blades are in their extended positions;

the cam device comprising an interference member and a pair of camming members, each camming member associated with and fixed to a respective blade and movable with the blade along a path of movement of the camming member relative to the ferrule when the blade moves between its extended and retracted positions;

the interference member being disposed in the ferrule through-slot and being axially fixed to the ferrule, the interference member being disposed in the path of movement of the camming members;

the camming members being disposed to contact the interference member and cooperatively generate an interference fit between them as the camming members move along their respective paths of movement, the interference fit between each camming member and the interference member resisting movement of the camming member past the interference member and thereby resisting pivotal movement of the blade associated with the camming member;

the camming members and the interference member being elastically deformable to clear the interference fits between the camming members and the interference member and enable the camming members to move past the interference member if there is sufficient force applied to the blade to clear the interference fit;

the cam device comprising each blade defining a slot extending into the blade from an open end of the slot, the slot having opposite sides and a portion of the blade being formed as a cantilever beam disposed on one side of the slot; and each camming member protrudes away from the cantilever beam of the blade associated with the camming member.

15. The expandable broadhead of claim 14 wherein each camming member protrudes into the blade slot of the blade associated with the camming member; and the camming members are closely adjacent to the interference member when the blades are in their retracted positions whereby the interference between the interference member and the camming members occurs substantially upon initial urging of the blades from their retracted positions towards their extended positions.

16. The expandable broadhead of claim 14 wherein each blade extends from a forward end of the blade to an opposite trailing end of the blade, the forward end of the blade being adjacent to the tip end of the ferrule when the blade is in the retracted position, and the cantilever beam of the blade is disposed on the back end of the blade;

the cantilever beam of each blade is disposed on the trailing end of the blade;

the camming member of each blade protrudes away from the trailing end of the blade; and the camming members are closely adjacent to the interference member when the blades are in their retracted positions whereby the interference between the interference member and the camming members occurs substantially upon initial urging of the blades from their retracted positions towards their extended positions.

17. The expandable blade of claim 14 wherein each blade has a thickness dimension in a direction parallel with the pivot axis of at least 0.054 inches.

18. An expandable broadhead for an arrow comprising:

a ferrule, at least one blade pivotally mounted to the ferrule and pivotable between retracted and extended positions about a pivot axis;

each blade of the at least one blade being a metal blade having a first side and an opposite second side separated by a thickness of the blade extending in a direction parallel with the pivot axis when the blade is mounted to the ferrule, each blade of the at least one blade being pivotally mounted on a pin extending through a hole in the blade, the pin extending through the blade from the first side to the second side of the blade; and each blade of the at least one blade comprising a cutting edge extending along a length of the blade between opposite ends of the cutting edge, the blade extending inwardly from the cutting edge into the blade in a direction transverse to the cutting edge along the entire length of the cutting edge to a uniform thickness portion of the blade extending along the length of the cutting blade, the uniform thickness portion of the blade having a thickness of at least 0.054 inches.

19. The expandable broadhead of claim 18 wherein each blade of the at least one blade comprises a transition portion extending from the cutting edge to the uniform thickness portion of the blade, the entire blade except for the transition portion having a uniform thickness of at least 0.054 inches.

20. The expandable broadhead of claim 19 wherein the thickness dimension of each blade is between 0.054 inches and 0.25 inches.

21. A broadhead comprising:

a ferrule, a blade pivotally mounted to the ferrule for pivotal motion between retracted and extended positions relative to the ferrule, and a cam device that resists pivotal movement of the blade from the retracted position towards the extended position;

the ferrule extending along an axis between a tip end and an opposite back end and comprising a through-slot extending along the axis and open on one side of the ferrule, the blade being disposed substantially within the ferrule slot when the blade is in the retracted position and extending out of the open side of the ferrule when the blade is in the extended position;

the cam device comprising a camming member and an interference member, the camming member being fixed to the blade and movable with the blade along a path of movement of the camming member relative to the ferrule when the blade moves between extended and retracted positions;

the interference member being disposed in the ferrule through-slot and being axially fixed to the ferrule, the interference member being disposed in the path of movement of the camming member;

the camming member and the interference member being disposed to contact one another and cooperatively generate an interference fit between them as the camming member moves along the path of movement, the interference fit resisting movement of the camming member past the interference member and thereby resisting pivotal movement of the blade; and the camming member and the interference member being elastically deformable to clear the interference fit and enable the camming member to move past the interference member if there is sufficient force applied to the blade to clear the interference fit; and the interference member being formed as a pin extending through the through-slot of the ferrule parallel with the pivot axis and spaced away from the pivot axis towards the back end of the ferrule.

22. The broadhead of claim 21 wherein the blade has a thickness in a direction parallel with the pivot axis of at least 0.054 inches.

23. The broadhead of claim 22 wherein the blade has a thickness in a direction parallel with the pivot axis of between 0.060 inches and 0.25 inches.

* * * * *